US011432597B2

(12) United States Patent
Temeng

(10) Patent No.: US 11,432,597 B2
(45) Date of Patent: Sep. 6, 2022

(54) PUMP-CONDITIONED GARMENT AND APPARATUS THEREFOR

(71) Applicant: Kwaku Temeng, Wilmington, DE (US)

(72) Inventor: Kwaku Temeng, Wilmington, DE (US)

( * ) Notice: Subject to any disclaimer, the term of this patent is extended or adjusted under 35 U.S.C. 154(b) by 612 days.

(21) Appl. No.: 16/502,854

(22) Filed: Jul. 3, 2019

(65) Prior Publication Data

US 2021/0000195 A1 Jan. 7, 2021

(51) Int. Cl.
*A41D 13/005* (2006.01)

(52) U.S. Cl.
CPC ..... *A41D 13/0053* (2013.01)

(58) Field of Classification Search
CPC ..... A41D 13/0158; A41D 13/0053; A41D 13/005
See application file for complete search history.

(56) References Cited

U.S. PATENT DOCUMENTS 5,970,519 A * 10/1999 Weber ..... A41D 13/0025 2/81
6,085,353 A 7/2000 van der Sleesen
6,105,382 A * 8/2000 Reason ..... A41D 13/005 165/46
6,109,338 A * 8/2000 Butzer ..... A41D 13/005 607/104
6,260,201 B1 * 7/2001 Rankin ..... A41D 13/0053 2/81
6,339,845 B1 1/2002 Burns
6,349,412 B1 * 2/2002 Dean ..... A41D 13/0053 2/102
6,681,399 B1 * 1/2004 Kerr ..... A41D 13/0125 2/2.5
7,412,728 B2 8/2008 Alesina
7,823,625 B2 * 11/2010 Gammons ..... F16L 37/0841 165/46
8,281,609 B1 * 10/2012 Rothschild ..... A41D 13/0053 62/259.3
8,397,518 B1 * 3/2013 Vistakula ..... A61F 7/02 62/3.5
9,309,689 B2 4/2016 Fier
(Continued)

FOREIGN PATENT DOCUMENTS

CN 215649363 U * 1/2022
WO WO-2017048198 A1 * 3/2017 ..... A41D 13/0005

OTHER PUBLICATIONS

Springs Creative Website, Spacer Fabric, https://www.springscreative.com/products/spacerfabric/, downloaded Jun. 26, 2019.
(Continued)

*Primary Examiner* — Jillian K Pierorazio
(74) *Attorney, Agent, or Firm* — Steven H. Meyer, Esq.

(57) ABSTRACT

To pump-condition a garment that covers at least a portion of an individual, at least one fluid-circulating vent panel circulates a fluid adjacent the garment in an effort to condition the individual. A pump provides a motive force to circulate the circulating fluid through each vent panel, and a conduit is routed within the garment and couples the pump and each vent panel. A controller controls the pump to provide the motive force, and a power source provides power to operate the pump and the controller. The pump may be an ultrasonic piezoelectric pump.

20 Claims, 4 Drawing Sheets

(56) References Cited

U.S. PATENT DOCUMENTS

2002/0029410 A1* 3/2002 Szymocha ..... A41D 13/0051 2/458
2003/0045918 A1* 3/2003 Turner ..... A61F 7/02 607/108
2005/0139351 A1* 6/2005 Chambers ..... A41D 13/005 62/259.3
2005/0197684 A1 9/2005 Koch
2006/0026743 A1 2/2006 Farnworth
2007/0000008 A1* 1/2007 Sawicki ..... A41D 13/0025 2/69
2007/0084496 A1* 4/2007 Edey ..... H01L 35/00 136/204
2007/0095088 A1* 5/2007 Drobot Isherwood ..... A41D 13/002 62/259.3
2008/0141428 A1* 6/2008 Kapah ..... A41D 13/0025 2/2.5
2009/0077710 A1 3/2009 Bay
2009/0199571 A1* 8/2009 Creech ..... A61F 7/02 62/515
2009/0260711 A1* 10/2009 Alder ..... B63C 9/18 2/458
2009/0308082 A1* 12/2009 Monk ..... G05D 23/1919 62/3.5
2010/0011491 A1* 1/2010 Goldmann ..... A42B 1/008 2/458
2010/0084125 A1* 4/2010 Goldstein ..... F17C 11/00 62/3.5
2010/0125928 A1* 5/2010 Smith ..... B63C 11/08 165/61
2010/0223943 A1* 9/2010 Loukaides ..... A41D 13/0053 62/259.3
2012/0036623 A1* 2/2012 Minogue ..... A41D 31/102 2/463
2013/0025315 A1* 1/2013 Freeman ..... F28D 15/04 165/46
2013/0178146 A1 7/2013 Stockett
2014/0130225 A1* 5/2014 Balzano ..... F41H 1/02 2/2.5
2014/0201891 A1* 7/2014 Turner ..... A41D 13/0015 2/455
2014/0222121 A1* 8/2014 Spence ..... A61F 7/02 607/104
2015/0025485 A1* 1/2015 Luckemeyer ..... A61M 1/964 604/319
2015/0374537 A1* 12/2015 Susi ..... A61F 7/007 607/104
2017/0095395 A1* 4/2017 Wennen ..... A61F 5/3707
2017/0099899 A1 4/2017 Pezzimenti

OTHER PUBLICATIONS

TTP Ventus Website, Disc Pump Products, https://www.ttpventus.com/products , downloaded Jun. 26, 2019.

* cited by examiner

PUMP-CONDITIONED GARMENT AND APPARATUS THEREFOR

FIELD

The present disclosure relates to a garment with an apparatus included therewith that pumps or otherwise circulates a fluid within the garment. More particularly, the present disclosure relates to such a garment and apparatus with an air pump for circulating venting air within the garment so as to provide a wearer of the garment with a more comfortable environment.

BACKGROUND

To protect an individual against wind, rain, and similar adverse environmental conditions, it is believed to be generally known that an external garment such as a running jacket, a ski jacket, a parka, and the like may be designed with a fabric shell or the like that has low air permeability so as to prevent external air from being admitted, perhaps in combination with an insulating layer. Thus, the fabric shell and the insulating layer if present act to keep adverse environmental conditions such as rain, snow, and cold air away from direct contact with the individual, and also to keep favorable environmental conditions such as warm dry air in closer contact with the individual.

Notably, when such individual wears such external garment during exercising, for example, the fabric shell and insulating layer if present provide good protection during the initial stages of exercising, when the body of the individual is relatively cool and dry. However, as the individual continues to exercise and the body thereof becomes relatively warm and wet, the fabric shell and insulating layer if present can tend to trap heat and moisture within the garment, to the point where the individual can become uncomfortably warm and humid within such garment. As should be appreciated, the fabric shell and insulating layer if present limit the venting of internal moisture and heat generated from such exercise so that the interior of the garment becomes uncomfortably humid and wet and creates a relatively high level of discomfort.

To alleviate such discomfort as caused by air impermeability and/or heat insulation in a garment, it is among other things known that air vents, water vapor vents, and/or the like may be incorporated into the garment so as to provide an exchange of heat and/or moisture between the internal environment of the garment and the external environment. Such vents may generally be characterized by control mechanisms such as zippers or sliders that open to allow for the exchange of air between the interior and exterior of the garment at the discretion of the individual wearing same, mesh panels in the fabric shell that allow for a continuous exchange of air, or the like.

However, such control mechanisms, mesh panels, and the like have been found to have drawbacks and limitations. Firstly, the individual wearing the garment typically may have to stop the exercising activity to make adjustments as necessary, for example to open or close zippers. Secondly, such adjustments may be physically challenging, such as for example if the zippers are on a back side of the garment. In such an instance, it may be that the garment must be removed for gaining access to such zippers. Thirdly, opening and/or opened vents during rain and snow events can lead to interior penetration of water within the garment, which can be uncomfortable and perhaps can lead to hypothermia. Fourthly, even when vents are opened, the full benefits of venting may be unachievable due to varying obstructions. Here, it may be that a vent is blocked internally by an insulating layer, or externally by an external object such as a covering garment, a backpack, or the like. With regard to a backpack in particular, it is known that covering the back of the individual therewith can allow an excessive amount of warmth and perspiration to build up thereat, regardless of whatever venting may be provided in the garment in such region.

In general, garment venting suffers from the difficulty of adjusting a vent to match a current level of exertion and also any change in ambient conditions. That is, current garment vents do not allow for increased venting during a time of exertion and also for decreased venting at a time of rest, without manual adjustment, and also do not allow for increased venting when the external ambient temperature rises and also for decreased venting when such external ambient temperature falls, also without manual adjustment. Likewise, current garment vents do not allow for changes in external humidity, in internal humidity, in daylight, in wind speed, etc. Instead, an individual wearing a vented garment must focus on such issues to the point of distraction, and oftentimes fails to do so with the result being that the individual becomes over-heated, over-perspired, and/or overly chilled, among other things, with resulting discomfort.

Convective air flow systems have been proposed which employ one or more fans to induce air flow into and out of a garment. However, the fans are blade-based and can become compromised if the blades encounter interference. Also, the fans become all but useless if covered by a covering garment, a backpack, etc., and generally the fans are conspicuous and yet not aesthetically pleasing.

Accordingly, a need exists for a pump-conditioned garment and apparatus therefor which can be employed to actively and adaptably vent a garment. Specifically, a need exists for such a garment and apparatus that pumps or otherwise circulates a fluid within the garment in an effort to establish an environment within the garment that is more comfortable to an individual wearing the garment. More particularly, a need exists for such a garment and apparatus with an air pump for circulating venting air within the garment in response to sensed changes to the environment within the garment and also changes to the external environment.

SUMMARY

The aforementioned needs are satisfied by an apparatus that pump-conditions a garment, where the garment covers at least a portion of an individual. In the apparatus, at least one fluid-circulating vent panel circulates a fluid adjacent the garment in an effort to condition the individual. A pump provides a motive force to circulate the circulating fluid through each vent panel, and a conduit is routed within the garment and couples the pump and each vent panel. A controller controls the pump to provide the motive force, and a power source provides power to operate the pump and the controller. The pump may be an ultrasonic piezoelectric pump.

BRIEF DESCRIPTION OF THE DRAWINGS

The foregoing summary as well as the following detailed description of various embodiments of the present innovation will be better understood when read in conjunction with the appended drawings. For the purpose of illustrating the various embodiments of the innovation, there are shown in the drawings embodiments that may be preferred. As should be understood, however, the innovation is not limited to the precise arrangements and instrumentalities shown. In the drawings.

DETAILED DESCRIPTION OF PREFERRED EMBODIMENTS

Figure 1:
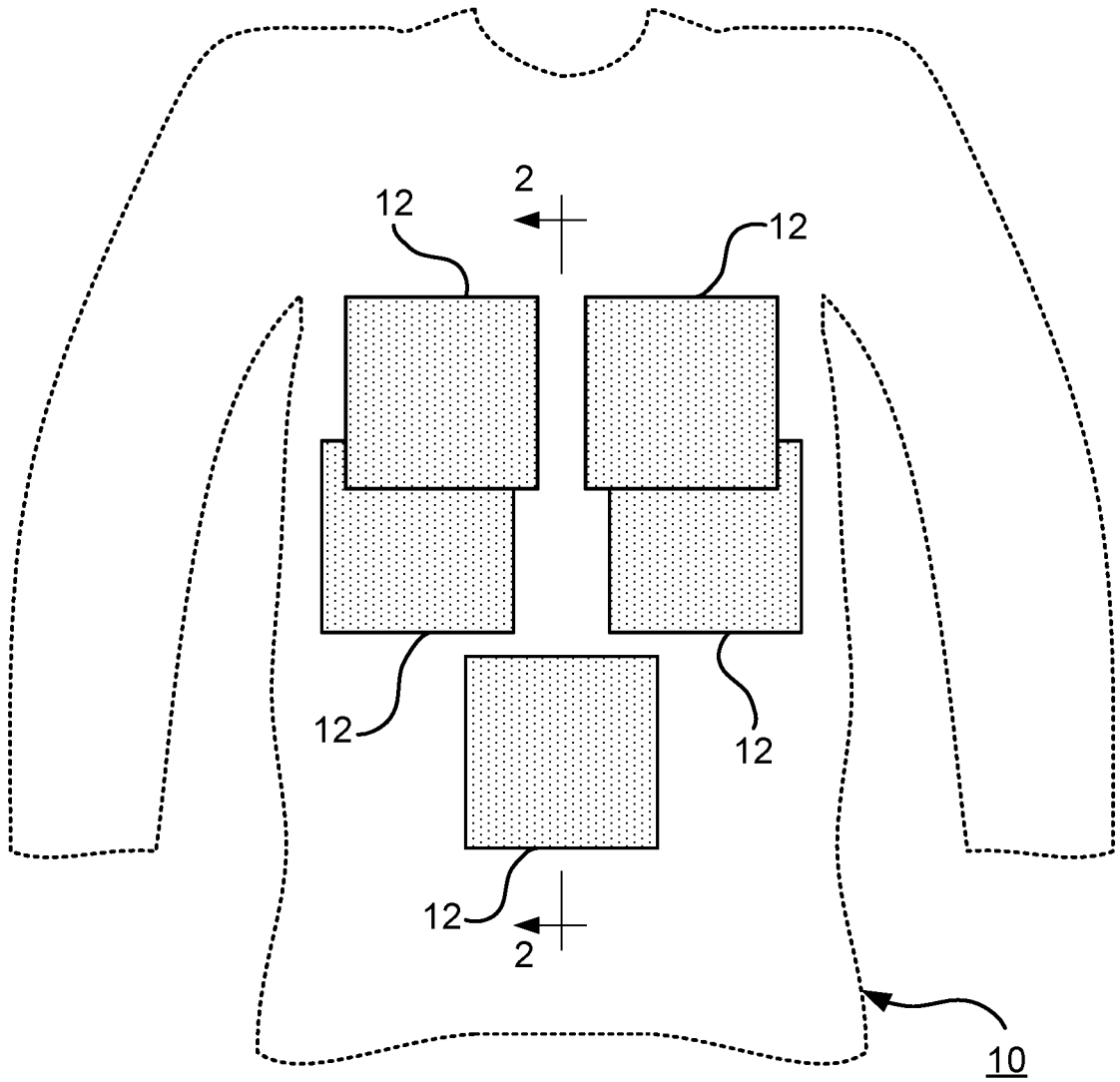
FIG. 1 is a front elevational and somewhat schematic depiction of a garment having one or more vent panels therein for circulating a fluid within the garment in accordance with various embodiments of the present innovation.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a tip" includes a plurality of tips. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present innovation, the preferred methods, constructs and materials are now described.

Figure 2:
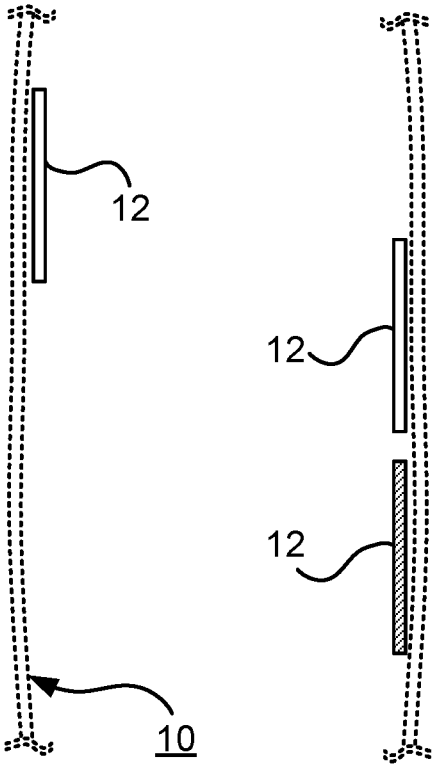
FIG. 2 is a cross-sectional view of the garment of FIG. 1 taken along the line 2-2 thereof, and in particular shows a vent panel on the left side of the front of the garment as seen in FIG. 1, a vent panel on the left side of the back of the garment as seen in FIG. 1, and a portion of a vent panel in the lower center of the back of the garment as seen in FIG. 1, in accordance with various embodiments of the present innovation.

Turning now to FIGS. 1 and 2, a representation of a pump-conditioned garment 10 is shown to include one or more fluid-circulating vent panels 12 in various embodiments of the present innovation. As shown in the representation of FIGS. 1 and 2, the garment 10 includes a pair of vent panels 12 on the left and right side of the interior of the front of the garment 10, another pair of vent panels 12 on the left and right side of the interior of the back of the garment 10, where the back pair are in elevation slightly lower than the front pair, and a single vent panel 12 in the lower center of the interior of the back of the garment, where the center panel 12 is in elevation below the rear pair.

As will be set forth in more detail below, each fluid-circulating vent panel 12 is intended to circulate a fluid such as air or a liquid adjacent the garment 10 in an effort to cool such adjacency and/or remove moisture, among other things. Notably, the garment 10 may be most any garment without departing from the spirit and scope of the present innovation. As shown in FIGS. 1 and 2, the garment 10 is generally shaped to be worn about the torso of an individual (not shown), although it is to be recognized that the garment 10 could also be shaped to be worn as pants about the legs, a hat on a head, sleeves for arms, leggings for legs, gloves for hands, socks or shoes for feet, etc. Likewise, it is to be recognized that the garment 10 could be shaped to be worn around a body or portion thereof of an animal such as a horse, a dog, a pack animal, etc. In fact, the garment 10 need not necessarily be an article of clothing, and instead could be an external item such as a blanket or other covering device. In general, the design of the garment 10 and functional use thereof may be most any design and use, and such design and use are generally known or should be apparent to the relevant public and therefore need not be set forth herein in any detail.

As was alluded to above, the garment 10 may be designed to protect the individual against wind, rain, and similar adverse environmental conditions, and for example may be designed with an exterior fabric shell or the like that has low air permeability so as to prevent external air from being admitted. Additionally, the garment may be designed to include an insulating layer for added thermal warmth. However, such fabric shell and such insulating layer are not a requirement of the present innovation. That said, it may be that based on the presence of such fabric shell and/or insulating layer in the garment 10, or based on the presence of other constructs in the garment 10, the individual wearing the garment 10 may grow to become uncomfortable, perhaps by being overheated during activity, by perspiring during activity, by accumulating humidity during activity, etc. Accordingly, the vent panels 12 are provided in the garment 10 in an effort to alleviate such overheating, perspiration, humidity, and other similar discomforting factors.

As shown in FIGS. 1 and 2, the vent panels 12 are located in regions of the garment 10 that correspond to areas of the body that typically experience heightened discomfort. As may be appreciated, if as is shown the garment 10 is a jacket or the like for being worn about the torso of an individual, the areas of the body for which discomfort may be experienced include the armpits, the chest, and the upper, central, and lower back, and the vent panels 12 may thus be located in corresponding regions of the garment 10. As should be appreciated, such areas of discomfort and corresponding regions in the garment 10 may be most any appropriate areas and corresponding regions without departing from the spirit and scope of the present innovation. Such regions and areas are generally known or should be apparent to the relevant public, and therefore need not be set forth in detail in the present disclosure other than that which is provided.

Each vent panel 12 may be attached to the garment 10 in any appropriate manner without departing from the spirit and scope of the present innovation. Depending on circumstances, it may be advisable to sew the vent panel 12 directly to the garment or to otherwise permanently attach same, perhaps by way of a gluing or welding operation or the like. Alternately, it may be advisable to removably attach the vent panel, perhaps by way of a zippering arrangement, a hookand-loop fastening arrangement, or the like. Attaching the vent panel 12 to the garment 10 is known or should be apparent to the relevant public and therefore need not be set forth herein in any detail other than that which is provided.

Generally, the garment 10 may be expected to have a primary interior surface and a primary exterior surface, among other things, where it is to be understood that the primary interior surface is that surface that faces toward and is closest to the body of the individual wearing the garment 10, and the primary exterior surface is that surface that faces away from and is farthest from the body of the individual wearing the garment 10. Empirically, it has been found that when the garment 10 is an over-garment such as a jacket or the like that is intended to be worn over another garment, each vent panel 12 works better when attached to the primary interior surface of such over-garment 10, as is the case in FIGS. 1 and 2.

Likewise, it has been found that when the garment 10 is an under-garment such as a shirt or the like that is intended to be worn next to the skin of the individual, each vent panel 12 works better when attached to the primary exterior surface of such under-garment 10. In particular, it has been found that by positioning each vent panel 12 away from the skin of the individual, the vent panel 12 is better able to circulate fluid about the individual and adjacent the vent panel 12 of the garment 10. Also, in the case where the garment 10 is an under-garment and is worn under another garment, attaching each vent panel 12 to the primary exterior surface of such garment 10 is more-or-less a functional equivalent to the case where the garment 10 is an over-garment worn over another garment and each vent panel 12 thereof is attached to the primary interior surface thereof, in that in both cases fluid is caused to flow between two layers of garment. Note though that if the garment 10 is a single layer worn by an individual without any other over- or under-garment, as may be the case during warm weather, the vent panel 12 should be attached to the primary interior surface of such garment 10 even though adjacent the skin of the individual. As will be set forth in more detail herein, the fluid circulated by each vent panel 12 is expected to be air, although other fluids may also be circulated without departing from the spirit and scope of the present innovation.

Figure 3:
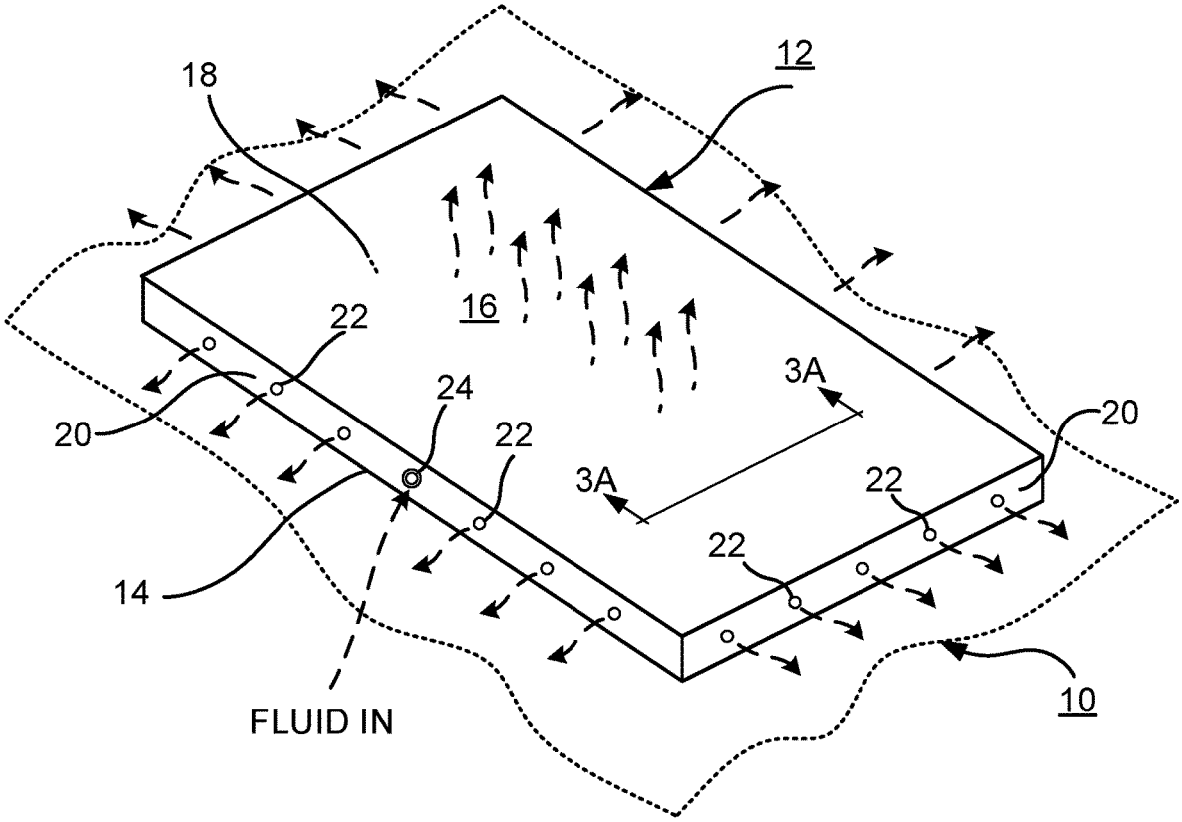
FIG. 3 is a partially cut-away perspective view of a vent panel from FIG. 1 and shows positive pressure flow therethrough in accordance with various embodiments of the present innovation.
Figure 3A:
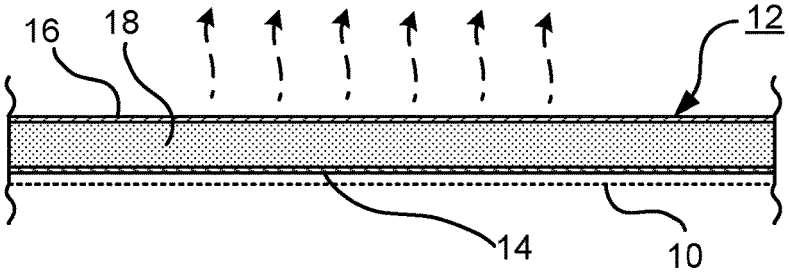
FIG. 3A is a cross-sectional view of the vent panel of FIG. 3 taken along the line 3A-3A thereof, and in particular shows the layers of the vent panel in relation to the garment in accordance with various embodiments of the present innovation.

Turning now to FIGS. 3 and 3A, it is seen that each vent panel 12 is generally of a multi-layer planar construction, with an impermeable attaching layer 14 at one face of the vent panel 12 which is intended to face toward the garment 10, a permeable diffusing layer 16 at the opposing face of the vent panel 12 which is intended to face away from the garment 10, and a circulation layer 18 interposed therebetween. Presumptively, the vent panel 12 and the layers 14, 16, and 18 thereof are generally flexible, at least enough so that the vent panel 12 is permitted to flex along with the garment 10 as attached thereto. Thus, the vent panel 12 does not impede the movement of the garment 10, such as may be advantageous if the garment is to be worn during exercise. The attaching layer 14 may for example be constructed from a plastic or elastomeric material or a lightweight woven fabric which is generally impermeable to the circulating fluid, be it air or otherwise, and correspondingly the diffusing layer 16 may for example be constructed from a plastic or elastomeric material or a knit/woven fabric with stretch which is indeed generally permeable to such circulating fluid, again be it air or otherwise.

As interposed between the attaching layer 14 and the diffusing layer 16, the circulation layer 18 may be constructed from a material that allows the circulating fluid, be it air or otherwise, to pass therethrough without undue constraint, and allow same to in fact circulate about the individual and adjacent the vent panel 12 within the garment 10. As an example, such circulation layer 18 may be constructed from a quilted microfilament yarn or the like, such that the circulation layer 18 is highly permeable to the circulating fluid, be it air or otherwise. One example of a product having such attaching layer 14, diffusing layer 16, and circulation layer 18 is Spacer Fabric as marketed by Springs Creative Products Group, LLC. of Rock Hill, S.C. (https://www.springscreative.com/products/spacerfabric/), or as marketed by Highland Industries of Greensboro, N.C. (https://highlandindustries.com/products/hiflow-spacer-fabrics/), although it should be appreciated that other products may alternately be employed without departing from the spirit and scope of the present innovation.

As seen in FIG. 3 in particular, the vent panel 12 with the layers 14, 16, 18 may also be provided with a peripheral edge band 20 or the like in an effort to manage the circulation of fluid, be it air or otherwise, through the vent panel 12. As shown, the peripheral edge band 20 essentially wraps around the periphery of the vent panel 12 in an effort to at least somewhat seal the edges of the vent panel 12 and thus restrict the circulation of fluid, be it air or otherwise. Accordingly, such circulating fluid is directed to flow more through the circulation layer 18 of the vent panel 12. As should be appreciated, then, the edge band 20 may for example be constructed from a plastic or elastomeric material which is generally impermeable to the circulating fluid, be it air or otherwise. Likewise, such generally impermeable edge band 20 may for example be imparted to the vent panel by fusing the material of the vent panel 12 at the edges thereof, perhaps by way of a heat source or by way of sonic welding or the like.

That said, such edge band 20 may be made to be at least partially permeable, by selecting an appropriate material, or by being manufactured to include venting pores 22 or the like, where the vent pores 22 have appropriate diameters and appropriate spacing. Such diameters may for example be on the order of 2-3 mm and such spacing maybe on the order of every 10-20 mm along the edge band 20. Judging an appropriate amount of permeability for the edge band 20 and manufacturing and/or introducing same into such edge band 20 is known or should be apparent to the relevant public and therefore need not be set forth herein in any detail beyond that which is provided. Accordingly, the edge band 20 may have any appropriate permeability and may be designed and manufactured in any appropriate manner without departing from the spirit and scope of the present innovation.

As may now be appreciated, each vent panel 12 within the garment 10 allows the circulation of fluid, be it air or otherwise, in one of at least two manners. In the first manner, and as shown in FIGS. 3 and 3A, positive pressure is introduced externally to the vent panel 12 in an effort to drive the circulating fluid (the directional arrows of FIG. 3) into the vent panel 12 by way of a port 24 thereof. As seen, the port 24 is located on or about the edge band 20 of the vent panel 12 and is in direct communication with the circulation layer 18 of the vent panel 12, although such port 24 may be located elsewhere if necessary and/or appropriate without departing from the spirit and scope of the present innovation. That said, locating the port 24 on or about the edge band 20 is believed to be advantageous in that the overall vent panel 12 may be generally flatter and accordingly less conspicuous. At any rate, upon being introduced into the vent panel 12 by way of the port 24, the circulating fluid then passes through the circulation layer 18 of the vent panel 12 and escapes therefrom and into the adjacent areas by way of the diffusing layer 16 of the vent panel and any venting pores 22 in the edge band 20 of the vent panel 12. Presumptively, such circulating fluid as supplied by the positive pressure is of a cooler and/or dryer nature than the environment within the garment 10, and thus provides a degree of comfort to the individual wearing same.

As might now be appreciated, in the second manner, which is in opposition to the manner shown in FIGS. 3 and 3A, negative pressure is introduced externally to the vent panel 12 in an effort to draw or pull the circulating fluid (the opposite of the directional arrows of FIGS. 3 and 3A) out of the vent panel 12 by way of the port 24 thereof. Thus, the circulating fluid is initially drawn from the adjacent areas by way of the diffusing layer 16 of the vent panel and any venting pores 22 in the edge band 20 of the vent panel 12, and then passes through the circulation layer 18 of the vent panel 12 and escapes from the vent panel 12 by way of the port 24. Here, it might be presumed that such circulating fluid as drawn out by the negative pressure is of a warmer and/or wetter nature than the environment outside the garment 10, and thus also provides a degree of comfort to the individual wearing same.

Depending on circumstances including use, function, manufacturability, and preference, among other things, it may be that either positive pressure or negative pressure is more suitable and/or desirable. Thus, if cooling is of primary importance, it may be that positive pressure is employed with the garment 10. Similarly, if humidity reduction is of primary importance, it may be that negative pressure is employed. Notably, circumstances may require a balancing of interests, wherein compromise is necessary. Thus, it may be that humidity reduction is desirable, but that the vent panels 12 are interior to a garment 10 that is to be worn against skin. In such case, negative pressure is more suitable to reduce the humidity, but may not be practical in that skin contact with the vent panels 12 would interfere with fluid flow as would otherwise be induced by such negative pressure. If so, it may be necessary to employ positive pressure rather than the more suitable negative pressure.

Note here that in either the first manner or the second manner, the circulation layer 18 should be of sufficient depth (top to bottom in FIG. 3A) so as to not impede the circulating fluid, but not so deep as to be perceived as being bulky or otherwise conspicuous. Such depth may of course vary based on many circumstances, but empirically it is believed that a depth of about 6-12 mm is sufficient in most cases.

With both the venting pores 22 in the edge band 20 of the vent panel 12 and the diffusing layer 16 in the vent panel 12, two kinds of circulation may be imparted within the garment. In particular, the venting pores 22 impart lateral flow along the surface of the garment 10, which is believed to be more likely to reduce humidity, and direct flow away from the surface of the garment 10, which is believed to be more likely to provide cooling. As should now be appreciated, depending on the location of the vent panel 12 and the function required thereby and thereat, and/or depending on personal preference, the circulation imparted thereby may be appropriately adjusted. For example, if lateral flow is desired at the expense of direct flow, the vent panel 12 may be constructed to have relatively more venting pores 22 and to have a relatively less permeable diffusing layer 16. Likewise, if direct flow is desired at the expense of lateral flow, the vent panel 12 may be constructed to have relatively less venting pores 22 and to have a relatively more permeable diffusing layer 16.

Figure 4:
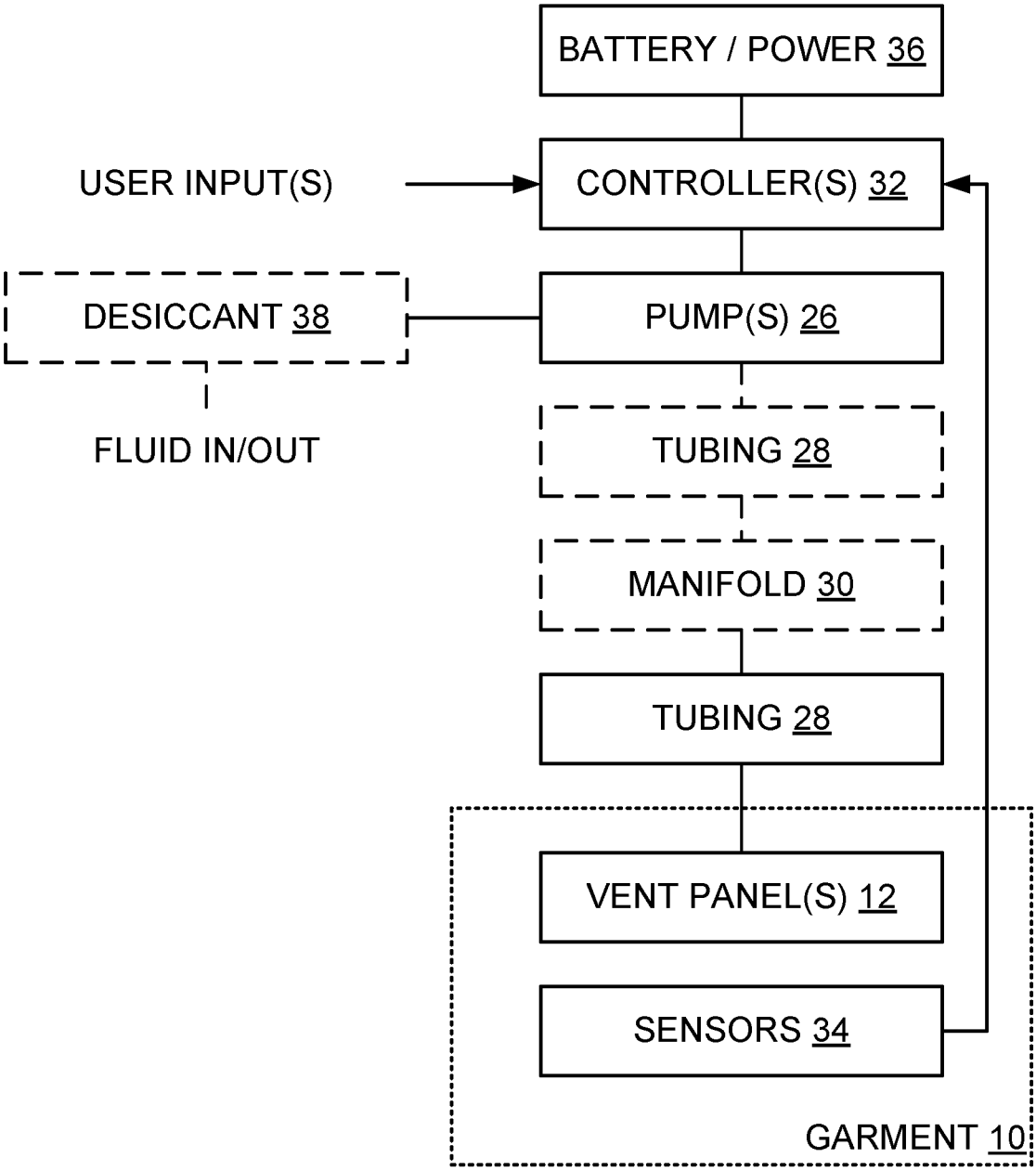
FIG. 4 is a block diagram of various components included with the vent panels of FIGS. 1-3 for operating same in accordance with various embodiments of the present innovation.

Turning now to FIG. 4, it is seen that the motive force that creates the positive or negative pressure is supplied by a pump 26 in various embodiments of the present innovation. As may be appreciated, the pump 26 may be any appropriate pump without departing from the spirit and scope of the present innovation, although it is to be appreciated that such pump should be small enough so as to be energy-efficient, light-weight, and inconspicuous, and yet large enough to be able to provide sufficient motive force. Selecting the appropriate pump 26 based on circumstances and design specifications is known or should be apparent to the relevant public, and therefore need not be set forth herein in any detail other than that which is provided.

In various embodiments of the present innovation, in order to satisfy the aforementioned goals, the pump 26 is an ultrasonic piezoelectric pump, such as for example one that is designed and/or marketed by TTP Ventus of Melbourn, Hertfordshire, United Kingdom (https://www.ttpventus-.com/products), or by CurieJet of Taiwan (http://www.curiejet.com/en/). As may be appreciated, using such an ultrasonic piezoelectric pump 26 is advantageous in many respects. In particular, such pump 26 has quiet (ultrasonic) operation at about 20-25 kHz, is free of vibration, is light-weight, and is relatively flat and inconspicuous and thus comfortable to wear. Moreover, such pump 26 is customizable and controllable, and is operated and cared for with ease. Thus, such pump 26 can be integrated into the garment 10 without undue difficulty.

The general characteristics of the pump 26 may be expected to vary depending on circumstances and applications. That said, it likely is the case that the pump 26 should be removable or detachable, so that the garment 10 can be washed, for example. Also, the pump 26 should have a flow rate of about 0 to 5 liters/minute in the case of air, controllable by the individual wearing the garment 10, and an exit flow velocity between 1 and 10 meters/sec, also in the case of air. The body of the pump 26 should be about 1-10 grams in mass, operate at temperatures between 10 and 120 degrees F., and have an output/input pressure of about 1 to 10 psi.

As shown in FIG. 4, the pump 26 may be coupled to the vent panel 12 within the garment 10 by way of a conduit such as an appropriate length of flexible tubing 28 which, as should be understood is appropriately routed within the garment 10 and between such pump 26 and such vent panel 12. Thus, the pump 26 may in fact be located somewhat remotely from the vent panel 12, presuming that the tubing 28 is of sufficient character to accommodate such an arrangement. In particular, the tubing 28 should be large enough to provide a relatively unimpeded flow of the circulating fluid, and yet not so large as to become conspicuous or bulky. Also, the tubing 28 should be flexible to accommodate the flexibility of the garment 10, and yet should have sufficient structural integrity so as to not collapse or otherwise block the flow of the circulating fluid. Within such parameters, the tubing 28 may be any appropriate tubing without departing from the spirit and scope of the present innovation. For example, the tubing 28 may be constructed from an impermeable plastic or elastomeric material, with an inner diameter of about 2-5 mm. Selecting the appropriate tubing 28 based on circumstances and design specifications is known or should be apparent to the relevant public, and therefore need not be set forth herein in any detail other than that which is provided.

Presumptively, the pump 26 operates based on drawing circulating fluid in from the environment external to the garment 10, if creating the aforementioned positive pressure, or based on expelling circulating fluid out to the environment external to the garment 10, if creating the aforementioned negative pressure. In either case, the pump 26 is presumptively located external to the garment 10 or has appropriate access thereto, perhaps by way of other tubing, ducting, or the like. In any event, it may be necessary and/or appropriate that either the tubing 28 between the pump 26 and the vent panel 12 or other tubing, ducting, or the like is required to breach the garment 10 in order to gain access to the interior thereof. However, it has been empirically found that such breaching is oftentimes unnecessary, and can be avoided by careful routing. Moreover, such breaching should be avoided if possible, especially if such breaching would be aesthetically unpleasing, or would tend to allow for water leakage, among other things.

In general, locating the pump 26, the tubing 28, and any other tubing, ducting, or the like in relation to the garment 10 may be done in any appropriate manner without departing from the spirit and scope of the present innovation, bearing in mind that the pump 26 in particular should be located in an area where overheating is avoided. For example, it may be that the pump 26 is in a pocket of the garment 10 and the tubing 28 snakes therefrom through and into the garment 10 to the vent panel 12. Likewise, it may be that the pump 26 is located externally on a sleeve of the garment 10 and the tubing snakes down the exterior of sleeve, through an arm-hole, and then up the interior of the sleeve toward the vent panel 12. Selecting the locations and routings may be done based on circumstances and design specifications, and is known or should be apparent to the relevant public, and therefore need not be set forth herein in any detail other than that which is provided.

Although thus far disclosed in terms of a single pump 26 and a single tubing 28 communicating same with a single vent panel 12, it is to be appreciated that multiple pumps 26, tubings 28, and vent panels 12 may be configured in a garment 10 without departing from the spirit and scope of the present innovation, as is alluded to in FIG. 4. As but one example, it may be that the garment 10 has three vent panels 12, each with a tubing 26 interposed between same and a common manifold 30, and also another tubing interposed between the manifold 30 and a single pump 26. Also, it may be that each vent panel 12 has a corresponding pump 26 dedicated thereto and in communication therewith by way of a dedicated tubing 28 (not shown), in which case no manifold 30 is believed to be necessary. Likewise, it may be that a single pump 26 is arranged to be in communication with a plurality of serially arranged vent panels 12 by way of appropriate connective tubing 26 (also not shown), in which case no manifold 30 is believed to be necessary. Accordingly, and as should be understood, configuring pumps 26, tubings 28, manifolds 30, and vent panels 12 within a garment 10 may be done based on circumstances and design specifications, and is known or should be apparent to the relevant public, and therefore need not be set forth herein in any detail other than that which is provided.

Still referring to FIG. 4, it is seen that each pump 26 is controlled by an appropriately configured controller 32. As may be appreciated, each pump 26 may be controlled by its own dedicated controller 32, or a single controller 32 may control multiple pumps 26, all without departing from the spirit and scope of the present innovation. Notably, each controller 32 may be a relatively simple device that controls each pump 26 thereof based on one or a few parameters selected by the individual wearing the garment 10, such as flow rate, or may be a more sophisticated device that controls each pump 26 thereof based on multiple parameters, perhaps based on a programmable control unit or the like. Accordingly, and as should be understood, the type and level of control provided by the controller 32 may be decided based on circumstances and design specifications, and is known or should be apparent to the relevant public, and therefore need not be set forth herein in any detail other than that which is provided.

If indeed multiple pumps 26 are employed with multiple vent panels 12 in the garment 10, it may be that the pumps 26 and vent panels 12 are arranged to circulate fluid adjacent the garment 10 from one vent panel 12 to another vent panel 12. As such, one pump 26 may introduce positive pressure to the one vent panel 12, and another pump 26 may introduce negative pressure to the another vent panel 12, in an effort to drive the circulating fluid therebetween. In doing so, and as should now be appreciated, the circulating fluid as supplied by the positive pressure from the one pump 26 can be employed to cool the environment within the garment 10, can accumulate humidity from such environment within such garment 10, and can then be drawn out by the negative pressure from the another pump 26. Such an arrangement is believed to be advantageous inasmuch as fluid circulation within the garment 10 is improved, and is believed to be more efficient.

As shown in FIG. 4, the controller 32 may be operated based on user inputs from the individual wearing the garment 10, and based on feedback from one or more sensors 34 placed within the garment 10, including one or more temperature sensors 34 and one or more humidity sensors 34, among other things. Such user inputs may be any appropriate inputs without departing from the spirit and scope of the present innovation. For example, such user inputs may include on/off control, flow rate control, percentage of max flow rate control, outlet pressure control, inlet pressure control, humidity control, and/or the like, among other things.

Generally, based on such inputs and such sensors 34, it may be that as temperature and humidity increase, the controller 32 operates the pump 26 to increase the circulation of fluid through each connected vent panel 12, and likewise as temperature and humidity decrease, the controller 32 operates the pump 26 to decrease the circulation of fluid through each connected vent panel 12, all in an effort to reach a desired level as set by the inputs from the individual. As may be appreciated, the sensors 34 and operating the controller 32 based thereon may be performed in any appropriate manner without departing from the spirit and scope of the present innovation. Such operating is known or should be apparent to the relevant public, and therefore need not be set forth herein in any detail other than that which is provided.

As is also shown in FIG. 4, a battery or other power source 36 may be provided to operate the pump 26, the controller 32, and other related elements. As should be expected, the power source 36 should be of sufficient capacity to operate for at least a few hours if not 8-10 hours, but should not be so large as to be too heavy and/or bulky, especially inasmuch as the individual wearing the garment 10 will be carrying such power source 36 too. Although the power source 36 may be most any appropriate power source without departing from the spirit and scope of the present innovation, it is generally expected that the power source 36 may be in the nature of a rechargeable lithium-ion battery or the like that is lightweight and can be recharged in a few hours, perhaps by way of a USB connector or the like. Such a power source 36 is known or should be apparent to the relevant public, and therefore need not be set forth herein in any detail other than that which is provided.

Presumptively, the power source 36, the controller 32, and the pump 26 may be located relatively closely with respect to each other, especially if there is no countervailing reason. That said, it may nevertheless be the case that such items may be remotely located from each other, perhaps if necessary to balance out the weight of the items across the individual wearing the garment 10, or if necessary to effectuate connections therebetween. As before with regard to the pump 26 and the vent panel 12, care should be taken in connecting such items to among other things avoid unnecessarily breaching the garment 10, and also to avoid placing the connections within the garment 10 in a manner that may be perceived as uncomfortable by the individual wearing the garment 10.

In operation, the pump 26 in particular may on occasion be required to draw in relatively humid external air for delivery to the vent panel 12 within the garment 10. Especially if humidity within the garment 10 is a concern, and in various embodiments of the present innovation, a desiccant 38 may be provided at the intake to the pump 26, as is shown in FIG. 4. Accordingly, the desiccant 38 acts to dry the humid air prior to exposing same to the pump 26 itself and also to the vent panel 12 and the interior of the garment 10. Thus, humidity within the garment 10 is hopefully not exacerbated by the relatively humid external air, and also the pump 26 and the vent panel 12 are protected from any harmful effects that may occur based on exposure to such relatively humid external air. As should be understood, the desiccant 38 may be most any appropriate desiccant without departing from the spirit and scope of the present innovation, and such desiccant 38 is known or should be apparent to the relevant public, and therefore need not be set forth herein in any detail other than that which is provided.

CONCLUSION

Any programming and protocols believed necessary to effectuate the processes performed by the controller 32 in particular for the pump-conditioned garment 10 of the present innovation should be relatively straight-forward and should be apparent to the relevant programming and protocol-setting public. Accordingly, such programming and protocols are not attached hereto. Any particular programming and protocols, then, may be employed to effectuate the various embodiments of the present innovation without departing from the spirit and scope thereof.

In the present innovation, a pump-conditioned garment 10 and apparatus therefor are set forth in which a pump 26 is employed to actively and adaptably vent the garment 10. The apparatus pumps or otherwise circulates a fluid within the garment 10 in an effort to establish an environment within the garment 10 that is more comfortable to an individual wearing the garment 10. The apparatus may include an air pump 26 for circulating venting air within the garment 10 in response to sensed changes to the environment within the garment 10 and also changes to the external environment.

It should be appreciated that changes could be made to the embodiments described above without departing from the innovative concepts thereof. For example, the garment 10 though primarily set forth as a wearable garment can also be any covering or protective device meant for an individual where the individual may wish to control the environment interior thereto. Also, although the pump 26 is set forth primarily in terms of operation with air, the pump 26 may instead operate with any other fluid, be it a gas or a liquid, as may be deemed necessary and/or desirable. Finally, although suggestions for placement of individual elements may be provided herein, such elements may be placed in any appropriate manner with respect to each other and with respect to the garment 10, again as may be deemed necessary and/or appropriate. It should be understood, therefore, that this innovation is not limited to the particular embodiments disclosed, but it is intended to cover modifications within the spirit and scope of the present innovation as defined by the appended claims.

The invention claimed is:

1. A pump-conditioned garment for covering at least a portion of an individual, the garment comprising:

first and second fluid-circulating vent panels, each of the first and second vent panels for circulating a fluid adjacent the garment in an effort to condition the individual;

a pump assembly for providing a motive force to circulate the circulating fluid through each of the first and second vent panels;

a conduit assembly routed within the garment and coupling the pump assembly and each of the first and second vent panels;

a controller for controlling the pump assembly to provide the motive force; and a power source for providing power to operate the pump assembly and the controller, the garment further comprising a covering layer, each of the first and second vent panels having a multilayer planar construction and including:

a port;

an attaching layer at one face of the vent panel and facing toward the covering layer, the attaching layer being generally impermeable to the circulating fluid, the vent panel being attached to the covering layer at the attaching layer;

a diffusing layer at an opposing face of the vent panel and facing away from the covering layer, the diffusing layer being generally permeable to the circulating fluid so as to allow such fluid to circulate therethrough in an effort to condition the individual; and a circulation layer interposed between the attaching layer and the diffusing layer, the circulation layer allowing the circulating fluid to pass therethrough between the port and the diffusing layer, each of the first and second vent panels further having a periphery and further including an edge band wrapped around the periphery, the port of the vent panel being positioned within the edge band of the vent panel and in communication with the circulation layer of the vent panel, the edge band of the vent panel being semi-permeable to the circulating fluid and defining therein a plurality of venting pores, the venting pores imparting a lateral flow of the circulating fluid along the covering layer of the garment, the diffusing layer of the vent panel imparting a direct flow of the circulating fluid away from the covering layer of the garment, the pump assembly including an ultrasonic piezoelectric pump with a mass of about 1-10 grams.

2. The garment of claim 1 for being worn about the torso of an individual and over an undergarment covering the individual, the garment having an interior surface and defining an interior space therein, each of the first and second vent panels being positioned on the interior face of the garment to condition the interior space defined thereby.

3. The garment of claim 1 for being worn about the torso of an individual and under an overgarment covering the individual, the garment having an exterior surface and defining an exterior space therein, each of the first and second vent panels being positioned on the exterior face of the garment to condition the exterior space defined thereby.

4. The garment of claim 1 for being worn about the torso of an individual and next to the individual, the garment having an interior surface and defining an interior space therein, each of the first and second vent panels being positioned on the interior face of the garment to condition the interior space defined thereby.

5. The garment of claim 1 wherein the pump assembly introduces to each of the first and second vent panels negative pressure to draw the circulating fluid therefrom, thereby removing moist warm air.

6. The garment of claim 1 wherein the pump assembly introduces to each of the first and second vent panels positive pressure to drive the circulating fluid thereinto, thereby adding cool dry air.

7. The garment of claim 1 wherein the pump assembly includes a first pump and a second pump, and the conduit assembly includes a first conduit and a second conduit, the first pump for providing motive force to circulate the circulating fluid through the first vent panel by way of the first conduit and the second pump for providing motive force to circulate the circulating fluid through the second vent panel by way of the second conduit.

8. The garment of claim 1 wherein the pump assembly includes a single pump, and the conduit assembly includes a first conduit, a second conduit, a third conduit, and a common manifold, the single pump for providing motive force to circulate the circulating fluid through both the first and second first vent panels, the first conduit coupling the common manifold with the first vent panel, the second conduit coupling the common manifold with the second vent panel, and the third conduit coupling the single pump with the common manifold.

9. The garment of claim 1 wherein the pump assembly includes a first pump and a second pump, and the conduit assembly includes a first conduit and a second conduit, the first pump for providing motive force to circulate the circulating fluid through the first vent panel by way of the first conduit and the second pump for providing motive force to circulate the circulating fluid through the second vent panel by way of the second conduit, the garment further comprising a single controller controlling the first and second pumps to provide the motive force.

10. The garment of claim 1 further comprising one or more sensors selected from one or more temperature sensors and one or more humidity sensors, wherein the controller operates based on user inputs from the individual, and based on feedback from the sensors.

11. The garment of claim 1 further comprising one or more sensors selected from one or more temperature sensors and one or more humidity sensors, wherein the controller operates based on user inputs from the individual, and based on feedback from the sensors, and wherein the garment defines an interior space therein, each of the first and second vent panels being positioned on the garment to condition the interior space defined thereby, and the sensors are positioned to sense the interior space.

12. The garment of claim 1 wherein the power source is a rechargeable lithium-ion battery.

13. The garment of claim 1 wherein the pump assembly draws in external air and delivers same to each of the first and second vent panels, the garment further comprising a desiccant at an intake to the pump, wherein the desiccant dries the external air if relatively humid external air prior to delivery to each of the first and second vent panels.

14. An apparatus for pump-conditioning a garment, the garment for covering at least a portion of an individual, the apparatus comprising:

first and second fluid-circulating vent panels, each of the first and second vent panels for circulating a fluid adjacent the garment in an effort to condition the individual;

a pump assembly for providing a motive force to circulate the circulating fluid through each of the first and second vent panels;

a conduit assembly for being routed within the garment and coupling the pump assembly and each of the first and second vent panels;

a controller for controlling the pump assembly to provide the motive force; and a power source for providing power to operate the pump assembly and the controller, the garment having a covering layer, each of the first and second vent panels having a multilayer planar construction and including:

a port;

an attaching layer at one face of the vent panel for facing toward the covering layer, the attaching layer being generally impermeable to the circulating fluid, the vent panel for being attached to the covering layer at the attaching layer;

a diffusing layer at an opposing face of the vent panel for facing away from the covering layer, the diffusing layer being generally permeable to the circulating fluid so as to allow such fluid to circulate therethrough in an effort to condition the individual; and a circulation layer interposed between the attaching layer and the diffusing layer, the circulation layer allowing the circulating fluid to pass therethrough between the port and the diffusing layer, each of the first and second vent panels further having a periphery and further including an edge band wrapped around the periphery, the port of the vent panel being positioned within the edge band of the vent panel and in communication with the circulation layer of the vent panel, the edge band of the vent panel being semipermeable to the circulating fluid and defining therein a plurality of venting pores, the venting pores for imparting a lateral flow of the circulating fluid along the covering layer of the garment, the diffusing layer of the vent panel for imparting a direct flow of the circulating fluid away from the covering layer of the garment, the pump assembly including an ultrasonic piezoelectric pump with a mass of about 1-10 grams.

15. The apparatus of claim 14 wherein the pump assembly introduces to each of the first and second vent panels negative pressure to draw the circulating fluid therefrom, thereby removing moist warm air.

16. The apparatus of claim 14 wherein the pump assembly introduces to each of the first and second vent panels positive pressure to drive the circulating fluid thereinto, thereby adding cool dry air.

17. The apparatus of claim 14 wherein the pump assembly includes a first pump and a second pump, and the conduit assembly includes a first conduit and a second conduit, the first pump for providing motive force to circulate the circulating fluid through the first vent panel by way of the first conduit and the second pump for providing motive force to circulate the circulating fluid through the second vent panel by way of the second conduit.

18. The apparatus of claim 14 wherein the pump assembly includes a single pump, and the conduit assembly includes a first conduit, a second conduit, a third conduit, and a common manifold, the single pump for providing motive force to circulate the circulating fluid through both the first and second first vent panels, the first conduit coupling the common manifold with the first vent panel, the second conduit coupling the common manifold with the second vent panel, and the third conduit coupling the single pump with the common manifold.

19. The apparatus of claim 14 wherein the pump assembly includes a first pump and a second pump, and the conduit assembly includes a first conduit and a second conduit, the first pump for providing motive force to circulate the circulating fluid through the first vent panel by way of the first conduit and the second pump for providing motive force to circulate the circulating fluid through the second vent panel by way of the second conduit, the garment further comprising a single controller controlling the first and second pumps to provide the motive force.

20. The apparatus of claim 14 further comprising one or more sensors selected from one or more temperature sensors and one or more humidity sensors, wherein the controller operates based on user inputs from the individual, and based on feedback from the sensors.

* * * * *